US010488103B2

(12) United States Patent
Lloyd et al.

(10) Patent No.: US 10,488,103 B2
(45) Date of Patent: Nov. 26, 2019

(54) MODIFIED REFRIGERATOR

(71) Applicants: Kimberly Lloyd, Pocatello, ID (US); Jim Creelman, Pocatello, ID (US); Marco Schoen, Pocatello, ID (US); Anish Sebastian, Pocatello, ID (US)

(72) Inventors: Kimberly Lloyd, Pocatello, ID (US); Jim Creelman, Pocatello, ID (US); Marco Schoen, Pocatello, ID (US); Anish Sebastian, Pocatello, ID (US)

(73) Assignee: Poten Enterprises, LLC, Pacatello, ID (US)

( * ) Notice: Subject to any disclaimer, the term of this patent is extended or adjusted under 35 U.S.C. 154(b) by 396 days.

(21) Appl. No.: 14/875,501

(22) Filed: Oct. 5, 2015

(65) Prior Publication Data

US 2016/0097582 A1 Apr. 7, 2016

Related U.S. Application Data

(60) Provisional application No. 62/059,765, filed on Oct. 3, 2014.

(51) Int. Cl.
*F25D 25/04* (2006.01)
*F25D 25/02* (2006.01)

(52) U.S. Cl.
CPC ..... *F25D 25/027* (2013.01); *A47B 2210/175* (2013.01); *F25D 25/04* (2013.01)

(58) Field of Classification Search
CPC . F25D 25/04; F25D 25/027; A47B 2210/175; A47B 2210/02; A47B 2210/0075; B65G 17/12; B65G 15/02; B66F 7/065
See application file for complete search history.

(56) References Cited

U.S. PATENT DOCUMENTS

| | | | | |
|---|---|---|---|---|
| 2,496,304 A * | 2/1950 | Muffly | F25D 17/02 | 194/277 |
| 4,498,890 A * | 2/1985 | Sutherland | B66B 23/022 | 474/140 |
| 5,191,267 A * | 3/1993 | Machacek | B65G 21/18 | 198/778 |
| 8,770,385 B2 * | 7/2014 | Hannessen | B65G 17/123 | 198/607 |
| 2009/0283539 A1 * | 11/2009 | Borra | G07F 11/36 | 221/258 |

* cited by examiner

*Primary Examiner* — David J Teitelbaum
(74) *Attorney, Agent, or Firm* — Michael L. Greenberg, Esq.; Greenberg & Lieberman, LLC

(57) ABSTRACT

A motorized rotating apparatus for the interior, thermally insulated compartment of a refrigerator is described. The apparatus has one or more guiding tracks and one or more movable shelves that remain upright while being moved up or down. The apparatus employs a motor which is configured to automatically rotate the shelves, moving them vertically and horizontally in the process. The apparatus facilitates access to the contents of the interior of the refrigerator without needing to reach to the rear of the refrigerator, nor bend down to reach contents at the bottom of the refrigerated insulated compartment.

8 Claims, 6 Drawing Sheets

MODIFIED REFRIGERATOR

CONTINUITY

This application is a non-provisional application of provisional patent application No. 62/059,765 filed on Oct. 3, 2014, and priority is claimed thereto.

FIELD OF THE PRESENT INVENTION

The present invention relates generally to modified refrigerator components, and more specifically relates to a rotary shelf for the interior of a refrigerator, configured to provide easy and expedient access to the contents of a refrigerator without necessitating reaching to the back of the refrigerator, nor bending over.

BACKGROUND OF THE PRESENT INVENTION

Shelves in conventional refrigerators are typically removable for cleaning, but immovable for access to stored items. In refrigerators with a freezer on top, items in the lower refrigerator portion are often stored at or below knee height. Viewing, retrieving and returning such items involves prolonged bending, stooping and reaching. These tasks can be overly physically demanding for someone who is tall, people with painful musculoskeletal conditions such as low back pain or arthritis, or individuals who have generalized weakness or impaired balance.

Conversely, in a refrigerator with a freezer on the bottom, items stored in the refrigerator portion can be at or above shoulder height. In this situation, access to stored items is overly physically demanding for shorter individuals and wheelchair users, but also challenging for people with painful musculoskeletal conditions, or those with generalized weakness or impaired balance. In side-by-side freezer/refrigerator units, items are stored both above shoulder height and below knee height, imposing both types of physical demand on the user.

To minimize physical stress to the musculoskeletal system and to decrease risk of falling in individuals with generalized weakness or impaired balance, it is generally recommended that an individual should reach no higher than shoulder height nor lower than hip level and should keep items, especially heavy items, as close to the body as possible [OHSA Tech Manual]. Shelf modifications are available which allow the shelves to move horizontally, closer to the user, but no modifications are available which allow movement in the vertical dimension, to raise or lower the shelf contents and no modifications are available which allow movement in both dimensions. Shelves capable of moving in both dimensions will position contents more readily in the recommended range, helping to minimize biomechanical stress and the associated injury and fall risk.

Thus, there is a need for a new modified refrigerator apparatus equipped with at least one rotating shelf configured to hold refrigerated items at an easily accessible height and location. Such a modified refrigerator with a rotating, preferably motorized, shelf system is preferably configured to facilitate unstrained access to the contents of the refrigerator for individuals.

A large number and variety of people can benefit from such a modified refrigerator, and because of the rapid aging of the population, that number is expected to increase dramatically in the near future. Due to the aging of the so-called "Baby Boomers," more than 20% of the population will be age 65 or older by the year 2029. [Colby and Ortman] This fact is especially relevant because older individuals are at greater risk of falling. Research suggests that as many as 35% of community-dwelling individuals over the age of 64, and up to 42% over the age of 70, fall each year [Yoshida].

The invention described herein can be expected to have a favorable impact on fall risk for the elderly because it will decrease the need for the individual to reach to access refrigerator contents and allow the contents to be more readily positioned within the limits of stability of the individual. Reaching for items beyond the limits of stability is one of the reasons people fall, [Clark] and those limits decrease due to a number of causes, including aging. [Tantisuwat] Other reasons limits of stability decrease include obesity, [Rossi-Izquierdo] chronic low back pain, [Sipko] amputations, [Molero-Sanchez] and a variety of neurological conditions, such as diabetic polyneuropathy, [Fahmy] migraine headaches, [Akdal] stroke, [Fu-ling] spinal cord injury, [Field-Fote] cerebral palsy, [El-Shamy] multiple sclerosis [Jackson] and Parkinson's [Hasmann] and Meniere's diseases. [Sevilla-Garcia]

The benefit of improved positioning of refrigerator contents is not restricted to just its effect on limits of stability, but also includes the potential to decrease physical stresses on the musculoskeletal system. Reaching while lifting is one of the causes of cumulative trauma disorders and associated musculoskeletal pain [OHSA Tech Manual]. Decreasing biomechanical stress while accessing refrigerator contents can have several benefits. Reduced stress can help to decrease pain and risk of further injury in individuals with any number of musculoskeletal conditions such as low back pain, arthritis, joint surgeries, and weakness. Limiting repetitive lifting stress will also help prevent the development of musculoskeletal wear and tear conditions such as low back pain and osteoarthritis. Furthermore, decreasing the physical stress of accessing refrigerator contents will also benefit individuals with cardiovascular and pulmonary disorders who have decreased functional capacity, such as those with COPD or coronary artery disease, and those who have undergone thoracic surgeries.

Individuals who require the use of a mobility device, such as a cane, walker or wheelchair will also benefit from the present invention, because it enables refrigerator contents to be positioned within their reach. It is estimated that 6.8 million community-dwelling Americans use mobility devices. [University of California] The majority of these are elderly, and have limitations in instrumental activities of daily living (IADL). These limitations stem in part from accessibility barriers in the home and include meal preparation. Taken together, it is evident that the number of people who might benefit from this device is quite large. Easier access to refrigerator contents may improve the ability of any of the potential beneficiaries to access refrigerated food, improving quality of life by decreasing fall risk, reducing pain and having a positive impact on nutrition and overall health. Because the elderly population could benefit to a great extent, this invention should make a substantial positive contribution to the "Aging in Place" movement. The Center for Disease Control defines aging in place as "the ability to live in one's own home and community safely, independently, and comfortably, regardless of age, income, or ability level." It is envisioned that the present invention certainly contributes directly to these goals.

SUMMARY OF THE PRESENT INVENTION

The present invention is a new, rotating refrigerator shelf apparatus for the interior, thermally insulated compartment of a conventional refrigerator or freezer. The apparatus is configured to be mounted within a conventional refrigerator, and is configured to rotate shelves around a curved track.

It should be understood that the present invention is a motorized rotating apparatus configured to replace original shelves and drawers in a standard refrigerator. The apparatus allows each shelf to move into an accessible position between shoulder and hip height, and close to the body of the user accessing the interior of the refrigerator. This positioning minimizes the need for the user to bend, stoop, or reach when accessing stored items thereby reducing the physical stresses imposed on the user. Such an apparatus could be built into new refrigerators or installed into existing refrigerators, replacing original standard shelves and drawers. The included diagrams relate only to the latter application.

BRIEF DESCRIPTION OF THE DRAWINGS

The present invention will be better understood with reference to the appended drawing sheets, wherein.

DETAILED DESCRIPTION OF THE PREFERRED EMBODIMENT

The present invention is a motorized rotating apparatus 10 configured to rotate about a curved track 12. The present invention is equipped with shelves 14 that are configured to rotate and pivot, preventing the contents of the shelves 14 from spilling or falling over during rotation.

Figure 1:
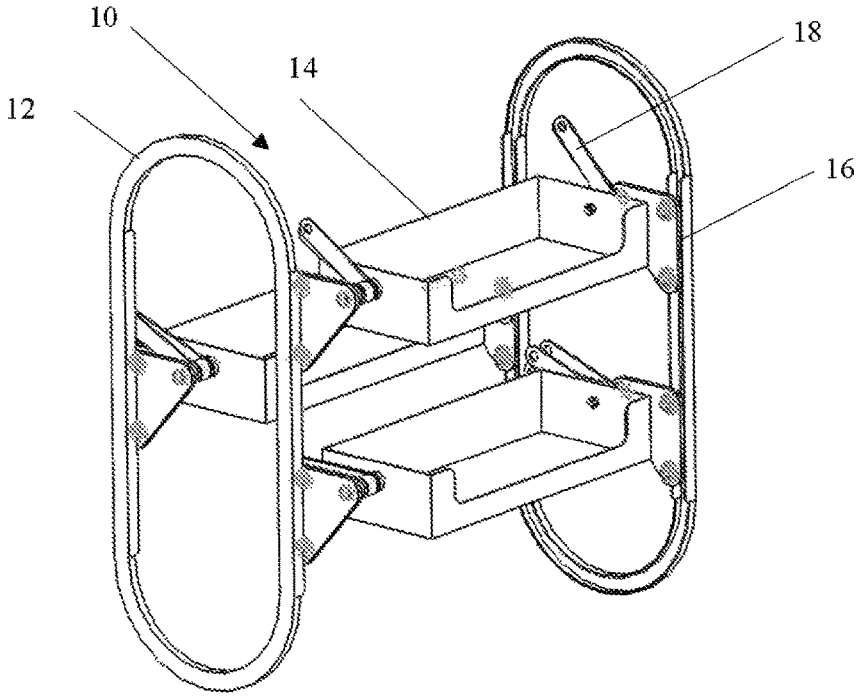
FIG. 1 is a perspective view of a motorized rotating apparatus of the present invention.

Referring now to the invention in more detail, in FIG. 1, the motorized rotating apparatus 10 is shown having at least one track 12 that is curved and preferably disposed vertically, allowing the shelves 14 to move up and down. The movement of the shelves is guided by roller plates 16 that run within the tracks 12, and are connected to the shelves 14. The roller plates 16 are preferably connected to a driven chain 20 using connecting rods 18. The shelves 14 remain upright throughout their movements in the tracks 12 with help of the roller plates 16.

In more detail, still referring to the invention of FIG. 1, the motorized rotating apparatus 10 as shown includes a set of shelves 14. The number of shelves can vary to the user's preference, but is limited by the amount of space provided within a refrigerator. The tracks 12 are composed of a straight section and two round sections at the bottom and top of the tracks 12. The tracks' 12 cross sections are in the form of a "u". Within the straight section of the tracks 12, the sides of the cross sections are larger in height compared to the sides of the tracks within the curved section. The smaller sides within the curved section at the top and bottom part of the tracks 12 allow for roller 22 to leave the guiding sides of the tracks 16, while the roller 24 remains in the tracks 16 guided by the two sides of the 'u' section.

Figure 6:
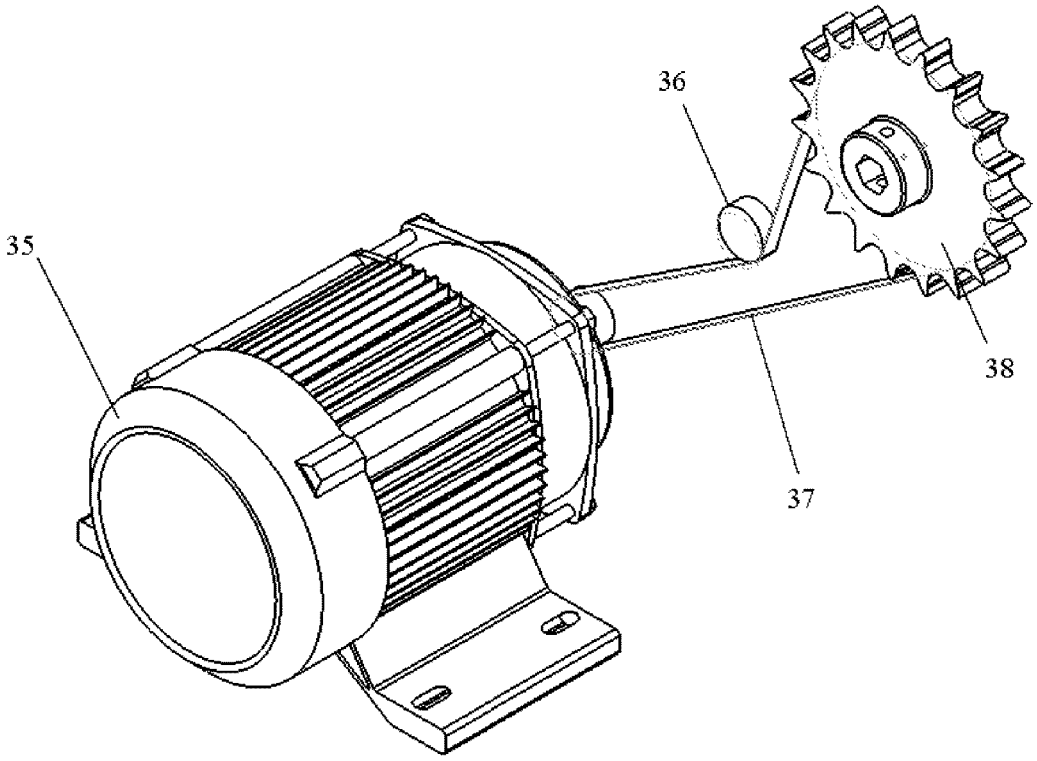
FIG. 6 is a perspective view of the endless chain drive of the present invention.
Figure 7:
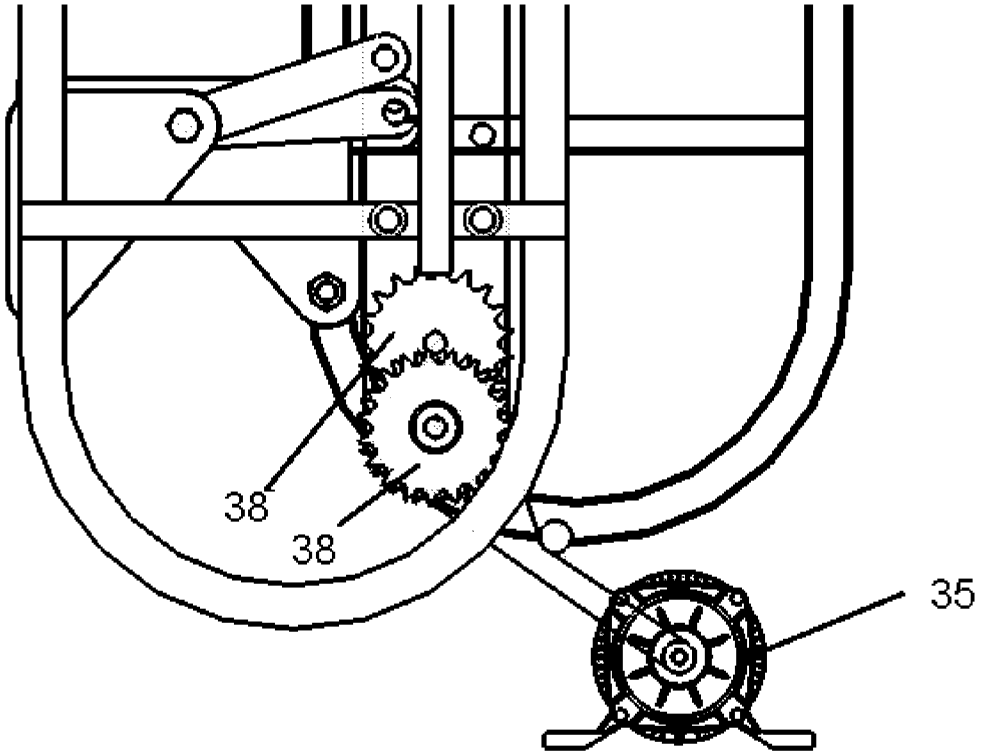
FIG. 7 is a perspective view of the linkage between the chain drive and the roller plates.
Figure 8:
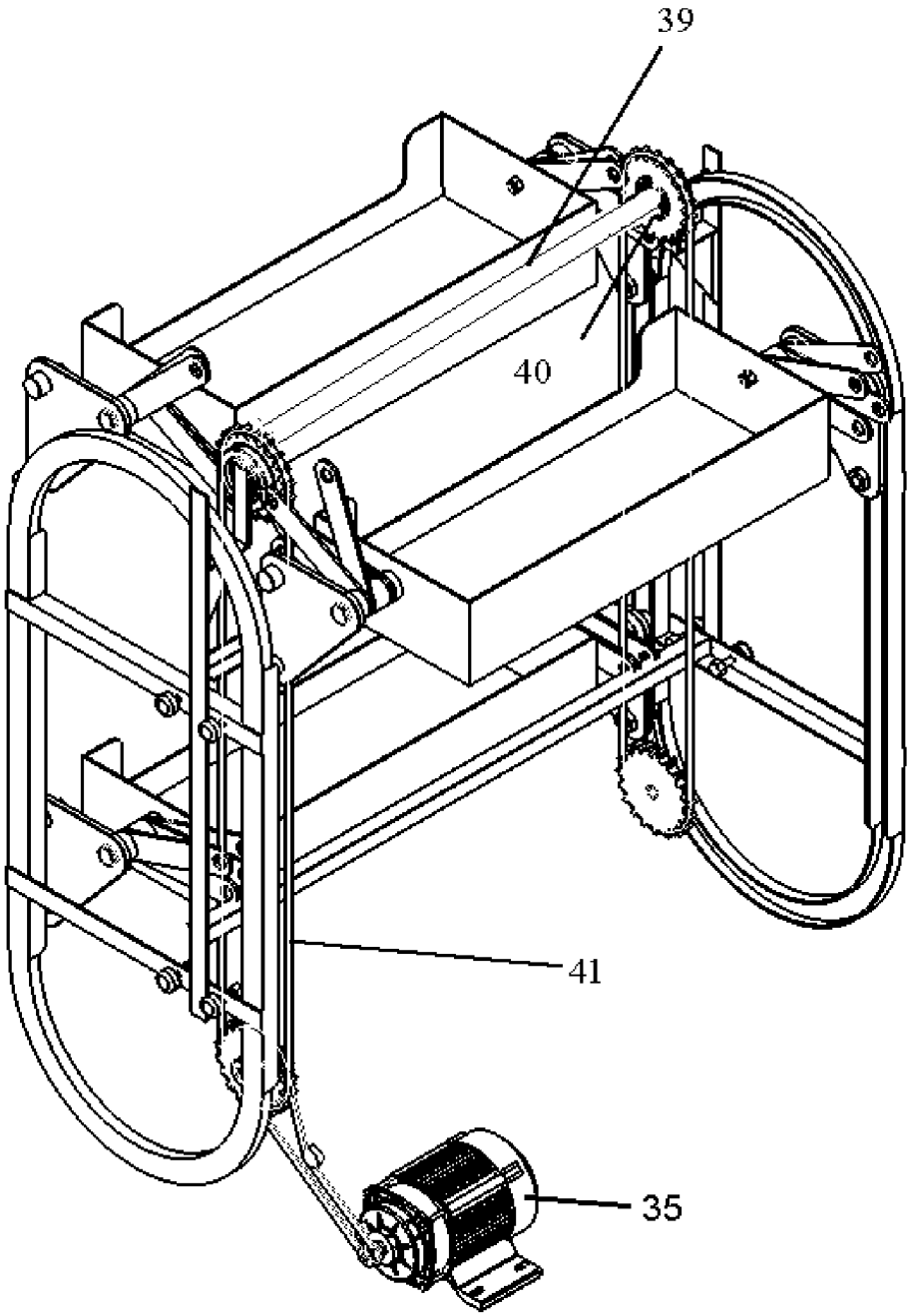
FIG. 8 is a perspective view of the entirety of the apparatus of the present invention assembled for use.

Referring to FIG. 7, it can be seen that the two sprocket wheels 38 are connected for co-rotation by a shaft 39 shown in FIG. 8, mounted on roller bearings 40 at the top and bottom of the chain link assembly. A torsion spring is fixed with its lower end connected to a crosspiece. The torsion spring has a variable length such that it can be used to exert a rotary force in the direction of a screw. This will help maintain tension in the chain used at the bottom of the motor-chain-sprocket drive mechanism. FIG. 6 schematically illustrates the drive mechanism which includes a sprocket 38, a motor 35, and the point where tension is applied by the torsion spring 36. The chain link of endless chain 37 is used to transfer the power from the motor 35 to the sprocket chain assembly which drives the shelves 14 in the intended direction. It is envisioned that the rotation of the present invention may be reversed by the user if needed.

Figure 2:
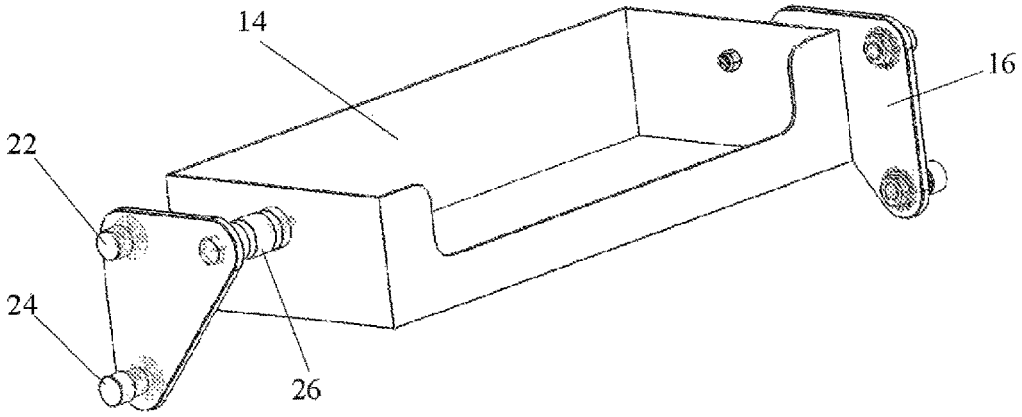
FIG. 2 is a view of the roller plates with one shelf unit mounted.

Referring now to FIG. 2, there is shown the details of the construction of the roller plates 16 with one shelf 14 unit. The roller plates 16 have one roller 22 mounted in close proximity to the roller plate 16 and one roller 24 mounted at a small distance away from the roller plate 16. Both rollers 22 and 24 follow the tracks 12 when the shelf 14 moves. When the shelf 14 follows the curved bend of the tracks 12, the roller 22 close to the roller plate 16 is free to move out of the tracks 12, while the roller 24 remains in the tracks 12 due to its further distance to the roller plate 16. This allows for the shelf 14 to remain upright during the passage of the curved section of the tracks 12. The roller plate 16 is connected to the shelf 14 using a hinge assembly 26.

In further detail, still referring to FIG. 2, the shelves 14 are sufficiently wide and long for fitting grocery items. The exact dimensions are scaled to the size of the refrigerator. The tracks 12 are sufficiently tall to fill the refrigerator.

Figure 3:
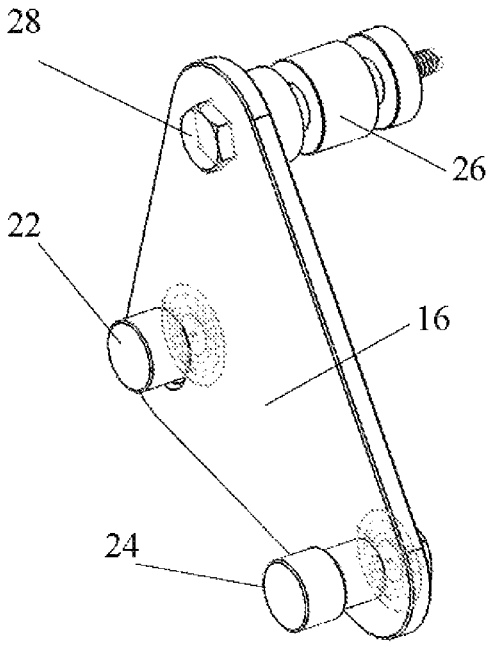
FIG. 3 is a perspective view of the roller plate assembly with the hinge assembly and the rollers.

Referring now to FIG. 3, there is shown the details of the roller plate 16 assembly with the hinge assembly 26 and the rollers 22 and 24. Roller 24 preferably stands further out than roller 22. The hinge assembly 26 is attached to the roller plate 16 and the shelf 14 using a bolt that does not allow for any relative rotation between the roller plate 16 and the shelf 14.

The construction details of the invention as shown in FIG. 1 and FIG. 2, allow the motorized rotating apparatus 10 to be made of stainless steel or of any other sufficiently rigid, strong, and safe material such as high-strength plastic, metal, and the like. Further, the various components of the motorized rotating apparatus 10 can be made of different materials.

Figure 4:
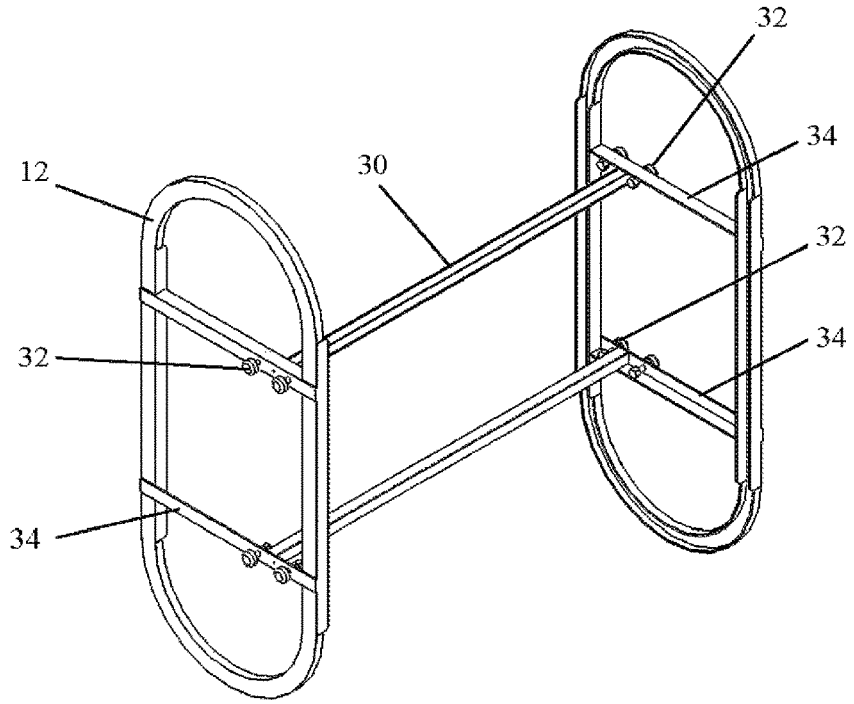
FIG. 4 is a perspective view of the mounting mechanism of the present invention to the inside of a refrigerator.

Referring now to FIG. 4, there is shown the tracks 12 with the cross beams 30 attached to the side bars 34 of the tracks 12. The cross beams 30 allow for the present invention to be fitted into a refrigerator by adjusting the lengths of the cross beams 30 according to the size of the interior of the refrigerator. The side bars 34 hold the adjustable knobs 32, that allow for mounting the present invention against the inside wall of the refrigerator. There are preferably two cross beams 30 and four side bars 34. Each side bar 34 preferably holds two adjusting knobs 32.

Figure 5:
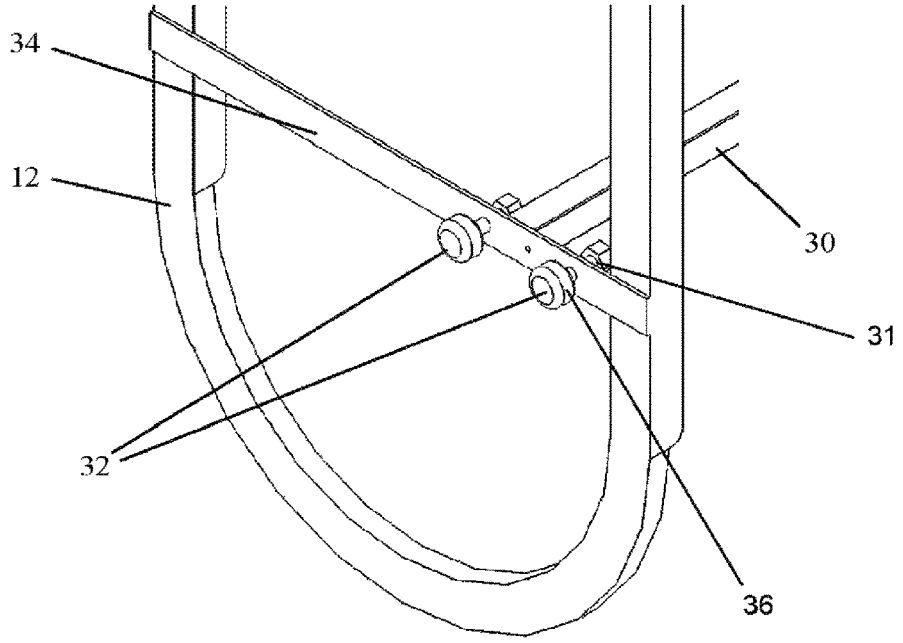
FIG. 5 is a view of the mounting screws that hold the present invention within the inside of a refrigerator.

Referring now to FIG. 5, the detailed view of one set of the adjusting knobs 32 is shown. In particular, the adjustable knobs 32 consist of having a soft head 36 mounted on a screw 31 that is screwed into the side bars 34.

Further referring to FIG. 6, it illustrates the drive of at least one sprocket 38 by means of an electric motor 35 which is preferably mounted to the cabinet housing of the refrigerator. An endless chain 37 is trained over the at least one sprocket 38 to co-rotate the sprocket on the other side of the shelf assembly of the present invention. The at least one sprocket 38 is connected to the motor output shaft by the endless chain 37. In order to maintain the tension of the endless chain 37, a device is provided which consists of a pivoted lever with a freely supported tensioning wheel 36. 36 will be connected to a power source to be driven by a suitable control algorithm to maintain the tension of the endless chain 37.

After the present invention has been in operation for an extended period of time, the two endless chains 37 and 41 will inevitably undergo elongation. This change in the length of the endless chains 37 and 41, which could be in the range of several centimeters, can be compensated for automatically by the measures described above. This proposed design feature in the present invention will significantly cut down the maintenance required over the lifetime of the modified refrigerator, reducing the need to replace the endless chains 37 and 41 frequently. The design of the torsion spring is configured to exert a constant rotary force on the spindle 36 of the present invention. Endless chain 37 may also be referred to as the first endless chain, and endless chain 41 may also be referred to as the second endless chain. It is envisioned that endless chain 37 may instead be a circular belt.

It should be understood that the present invention is envisioned for use in conventional refrigerators, and is preferably equipped with a modular mounting mechanism to facilitate the installation of the present invention in refrigerators produced by a wide assortment of manufacturers. Similarly, it should be understood that the motor 35 employed by the present invention is preferably brushless and nearly silent. Similarly, the curved tracks 12 of the present invention are preferably lubricated, and may employ an O-ring sealed chain or belt as endless chain 41.

Additionally, the present invention is preferably activated by the user via conventional means, such as via a manual switch, motion detection switch, light detection switch, capacitive touch switch, or other similar switch. The movement of the shelves is preferably managed by at least one microcontroller in order to calibrate and manipulate the access height of the shelves (14) to satisfy individual physical requirements, minimizing biomechanical stress for the user. It should be understood that the present invention is configured to rotate clockwise or counter-clockwise according to the preference of the user. The switch employed is preferably capable of activating forward or reverse rotation at the will of the user.

In short, the present invention is a device for modification of refrigerator shelves that provides for easier, saver access to the contents of the refrigerator. The modification allows the shelves to move under external power in both the vertical and the horizontal dimensions. The vertical and horizontal movement of the shelves enables the shelves and contents to achieve a position that minimizes biomechanical stress for the user. It should be noted that the present invention is especially beneficial for individuals with mobility deficits, including those who require mobility devices, such as walkers, wheelchairs, canes, and scooters.

Additionally, the present invention is beneficial to individuals who are at risk of falling, including elderly individuals and persons with balance or vestibular disorders. Similarly, individuals with neurological disorders, including stroke, brain injury, multiple sclerosis, or Parkinson's disease, individuals benefit from the use of the present invention. The present invention is also intended for individuals with health conditions that required them to minimize their physical exertion, including chronic obstructive pulmonary disease, heart disease, post thoracic surgery, congenital heart failure, and other conditions. Additionally, individuals with painful or debilitating musculoskeletal conditions, including arthritis, low back pain, frozen shoulder, post orthopedic surgery, etc.

With consistent use, the present invention can be expected to help prevent the development or progression of overuse or repetitive strain injuries. Likewise, with consistent use, the present invention provides a decrease in food waste by providing easier access, improves the diet diversity of users, and can facilitate the cleaning of the shelves of the refrigerator to maintain sanitary conditions within the refrigerator.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

REFERENCES

Akdal, G., Donmez, B. & Angin, S. (2009). Is balance normal in migraines without history of vertigo? *Headache, Vol* 49, 3, 419-425.

Centers for Disease Control: National Aging in Place Council. http://naipc.org/

Clark, S., Iltis, P. W., Anothony, C. J., & Toews, A. (2005). Comparison of older adult performance during the functional-reach test and limits-of-stability tests. *Journal of Aging and Physical Activity, Vol* 13, 3, 266-275.

Colby, S. L. & Ortman, J. M. (2014). United States Census Bureau. The baby boom cohort in the united states: 2012-2060. *Population Estimates and Projections/Current Population Reports*, May 2014. www.census.gov El-Shamy, Shamekh Mohamed & Abd El Kafy, Eham Mohamed. (2014). Effect of balance training on postural balance control and risk of fall in children with diplegric cerbral palsy. *Disability & Rehabilitation, Vol* 36, 14, 1176-1183.

Fahmy, Ibtesam M., RAmzy, G. M., Salem, N. A., Ahmed, G. M., & Mohammed, A. A. (2014). Balance disturbance in patients with diabetic sensory polyneuropathy. *Egyptian Journal of Neurology, Psychiatry & Neurosurgery, Vol* 51, 1, 21-29.

Field-Fote, E. C., & Ray, S. S. (2010). Seated reach distance and trunk excursion accurately reflect dynamic postural control in individuals with motor-incomplete spinal cord injury. *Spinal Cord, Vol* 48, 10, 745-749.

Fu-ling, T., Yea-Ru, Y., Chao-Chung, L., & Ray-Yau, Wang. (2010). Balance outcomes after additional sit-to-stand training in subjects with stroke: a randomized controlled trial. *Clinical Rehabilitation,* 6, 533-542.

Hasmann, S. E. et. Al. (2014). Instrumented functional reach test differentiates individuals at risk for Parkinson's disease from controls. *Frontiers In Ageing Neuroscience,* 6, 286-286.

Jackson, Kj. (2002) Thesis: The effects of balance training on personals with multiple sclerosis. Union Institute University.

Molero-Sanchez, A., et. Al. (2015). Comparison of stability limits in medn with traumatic transtibial amputation and a non-amputee control group. *PM & R: The Journal of Injury, Function and Rehabilitation, Vol* 7, 2, 123-129.

OSHA Tech Manual. OSHA Technical Manual (OTM)|Section VII: Chapter 1—Back Disorders and Injuries Rossi-Izquierdo, M. et. al. (2015) Impact of obesity in elderly patients with postural instability. *Aging Clinical and Experimental Research*, Jul. 18, 2015.

Sevilla-Garcia, M. A., Bleas-Aguirre, M. S., & Perez-Fernandez, N. (March 2009). The limits of stability in patients with Meniere's disease. *Acta Oto-Laryngologica, Vol* 129, 3, 281-288

Sipko, T. & Kuczynski, M. (2013). The effect of chronic pain intensity on the stability limits in patients with low back pain. *Journal of Manipulative and Psysiological Therapeutics, Vol* 36, 9, 612-618.

Tantisuwat, A. & Chamonchant, D. & Boonyong, S. (2014). Multi-directional reach test: An investigation of the limits of stability of people aged between 20-79 years. *Journal of Physical Therapy Science, Vol* 26, 6, 877-880.

University of California. (2015). Mobility Device Statistics—United States. Disabled World toward tomorrow.

Yoshida, S. A Global Report on Falls Prevention: Epidemiology of Falls. Ageing and Life Course Family and Community Health. World Health Organization http://www.who.int/ageing/projects/1.Epidemiology%20of%20falls%20in%20older%20age.pdf

We claim:

1. A device for moving goods from a specific position to another which is user defined based on user preference within a closed confined space while keeping the goods on the moving shelf in an upright position throughout the travelled path, the device comprising:

a mounting structure to affix the device within the closed confined space;

a drive system moving shelves in a closed-loop within the closed confined space, shelves to carry goods, a curved guiding path;

at least one shelf connected to the driving plate, both of which remain upright at any position during the entire motion;

at least two driving plates, mounted at each side of the shelf using bearings, nuts, and bolts;

chain drives, said chain drives equipped with two sprockets each and driven by a motor;

at least two connecting rods for each driving plate, connecting the driving plate with the chain drives;

at least one guiding path, where rollers guide said at least one shelf using said at least two connecting rods and said at least two driving plates;

wherein rollers mounted to the drive plate configure a guiding path that causes said at least one shelf and said at least two driving plates to remain upright through the entire motion;

wherein said guiding path is comprised of a variable radius are dependent on the instantaneous position of said at least one shelf along the curved section of the path, and a straight path for the linear section; and wherein the curved section of the path is defined by the driving plate's geometry in relation to the size of said sprockets, said driving plates, said connecting rods and chain size.

2. A device as claimed in claim 1, wherein a shelf can be moved along the curved and linear sections of the path and stopped at any position of the path for the user to access the goods contained in the shelf.

3. The apparatus of claim 2, wherein said at least one shelf is configured to traverse the entirety of said guiding path, said linear path, and said curved section of the path, a full rotation, without a disturbance in the contents of said at least one shelf.

4. The apparatus of claim 1, further comprising:

at least one microcontroller; and wherein said at least one microcontroller is configured to adjust the position of said at least one shelf.

5. The apparatus of claim 4, further comprising: a control switch, wherein said control switch is activated via one of the following: voice activation, keypad, toggle switch, push button switch, mobile device application switch.

6. The apparatus of claim 5, wherein the curved path amounts to a specific arc configured to ensure contents of each of the shelves do not touch during movement across the curved portion of the path.

7. The apparatus of claim 5, wherein said at least two driving plates are connected to said at least one shelf via a hinge assembly.

8. The apparatus of claim 1, wherein the curved path amounts to a specific arc configured to ensure contents of each of the shelves do not touch during movement across the curved portion of the path.

* * * * *